US009125449B1

(12) United States Patent
Wagemans

(10) Patent No.: US 9,125,449 B1
(45) Date of Patent: Sep. 8, 2015

(54) BRACKET FOR SUSPENDING A WIRELESS CELL PHONE EAR PIECE FROM A CAP

(76) Inventor: Gregory Wagemans, Milton, WA (US)

( * ) Notice: Subject to any disclaimer, the term of this patent is extended or adjusted under 35 U.S.C. 154(b) by 605 days.

(21) Appl. No.: 13/551,615

(22) Filed: Jul. 18, 2012

Related U.S. Application Data

(63) Continuation-in-part of application No. 12/504,121, filed on Jul. 16, 2009, now abandoned.

(60) Provisional application No. 61/081,101, filed on Jul. 16, 2008.

(51) Int. Cl.
*A42B 1/24* (2006.01)
*A42B 3/30* (2006.01)

(52) U.S. Cl.
CPC ..... *A42B 1/245* (2013.01); *A42B 3/306* (2013.01)

(58) Field of Classification Search
CPC ..... A42B 1/245; A42B 1/24; A42B 3/306; A42B 1/242; A42B 1/244; A42B 1/247
USPC ..... 224/181, 197; 2/209.13, 422; 455/575.2; 381/301, 376, 375, 374; 24/537, 542
See application file for complete search history.

(56) References Cited

U.S. PATENT DOCUMENTS

| | | | | |
|---|---|---|---|---|
| 3,461,463 | A * | 8/1969 | Beguin | 2/423 |
| 3,946,466 | A * | 3/1976 | Sakai | 24/568 |
| 2002/0069488 | A1* | 6/2002 | Morris | 24/3.12 |
| 2004/0132509 | A1* | 7/2004 | Glezerman | 455/575.2 |

* cited by examiner

*Primary Examiner* — Adam Waggenspack
*Assistant Examiner* — Matthew Theis
(74) *Attorney, Agent, or Firm* — Joseph Z. Ellsworth

(57) ABSTRACT

An earpiece bracket that conveniently attaches to a cap worn by a user with length adjustment such that the distance between the cap to the earpiece is adjustable in the bracket. The attachment is pivotable so the bracket may swing the earpiece into and out of its operational position. In use, the earpiece depends in the bracket from the cap into an operational position with the speaker portion of the earpiece urged against the user's ear at the external auditory meatus. The earpiece swings into place during use and away from the ear when not use. The earpiece speaker portion is held against ear at the external auditory meatus under spring bias in the attachment of the bracket to the cap.

18 Claims, 6 Drawing Sheets

BRACKET FOR SUSPENDING A WIRELESS CELL PHONE EAR PIECE FROM A CAP

This continuation in part application is derived from application Ser. No. 12/504,121 which in turn is derived from the provisional application filed Jul. 16, 2008 under serial number 61081101 and claims the benefit of that filing date.

BACKGROUND

1. Field of the Invention

This invention relates generally to cell phone earpieces and more specifically to a bracket for suspending an earpiece from a cap instead of from an auricle of an ear.

2. Prior Art

Ear pieces that work in coordination with a cell phone are now becoming common, allowing hands free cell phone use, both for convenience and for operation of a vehicle. The operation of the ear piece depends on maintaining placement of the speaker portion of the ear piece at the external auditory meatus so very little volume is required and external noise is minimized. Typically, an ear piece is sold with a mount that has a C-shaped portion that wraps around and behind a user's auricle. The ear piece in the mount is then adjusted with its speaker portion at the acoustic meatus where it is partially held in place by the tragus in combination with the C-shaped portion of the mount.

The ear piece mount is uncomfortable and unsightly. Because it is sometimes offensive to a user, it is often separated from the earpiece and the earpiece is used without the mount, in which case the earpiece is held to the ear only by placing the speaker portion inside the tragus. This is less than a stable mount but still sometimes preferable to using the C-shaped portion of the mount. A mount that is comfortable and still effective is still needed.

While the earpiece is not in use, it is typical to keep the earpiece in the tragus. This can be off-putting to those attempting to have a conversation in person because it is unclear who the earpiece user is talking to; a person on the phone or the person in front of them. Also, it has become gauche in society to walk around with an earpiece in the ear.

It is then an object of the present invention to provide an ear piece mounting bracket that is comfortable to use even for extended periods of time. It is a further object that earpiece not be forced into the auditory meatus by the bracket but instead to be positioned over the ear canal so the user can urge it into the ear at their discretion. It is another object that the bracket holds the ear piece to the external auditory meatus independent of the user's auricle. It is a still further object that the ear piece be conveniently movable away from the auricle and external auditory meatus when not in use so it does not become an irritant to the user and still quickly returned to its operational position when needed for use.

SUMMARY

These objects are obtained in an earpiece bracket that conveniently attaches to a cap worn by a user. The attachment is pivotable so the bracket may swing the earpiece into and out of its operational position. In use, the earpiece depends in the bracket from the cap into an operational position with the speaker portion of the earpiece positioned near the user's ear at the external auditory meatus. The earpiece swings into place during use and away from the ear when not use. The earpiece speaker portion is held near the ear at the external auditory meatus under spring bias in the attachment of the bracket to the cap. With the earpiece swung temporarily to the external auditory meatus for a brief period of use and then swung back to the cap until it is needed again, the earpiece is comfortable when in use and does not become an irritant to the ear because of its brief periods of contact with the ear.

Persons will have a slightly different manner in regard to where they prefer to wear a cap. Therefore, the bracket provides a length adjustment such that the distance between the cap to the earpiece is adjustable in the bracket.

The bracket is also adjustable and can open and lock around the neck of most of the many brands and sizes of earpieces sold on the market. The bracket also has a locking mechanism that locks the bracket onto the neck of a wireless earpiece using compliant force and friction. This allows for facile removal and attachment of various earpieces that can be easily locked into place.

The earpiece mounting device can be used with any product designed to provide sound to the ear by adapting the product for mounting to the earpiece mounting device of the present invention as described herein. In referring to an earpiece generally for ease of description, the earpiece is meant to include a wireless telephone earpiece used in association with a cellular phone for hands free operation of the cellular phone, a music player and any similar sound device mountable to the ear for receiving a wireless signal and producing sound to the ear. Use of the term "wireless" is also used for ease and simplicity of description and for all purposes herein should be deemed to include all methods and protocols of transmitting and receiving a data signal without wires. The well-known protocol known as Bluetooth is one such protocol commonly used presently.

DETAILED DESCRIPTION OF THE PREFERRED EMBODIMENTS

Figure 1:
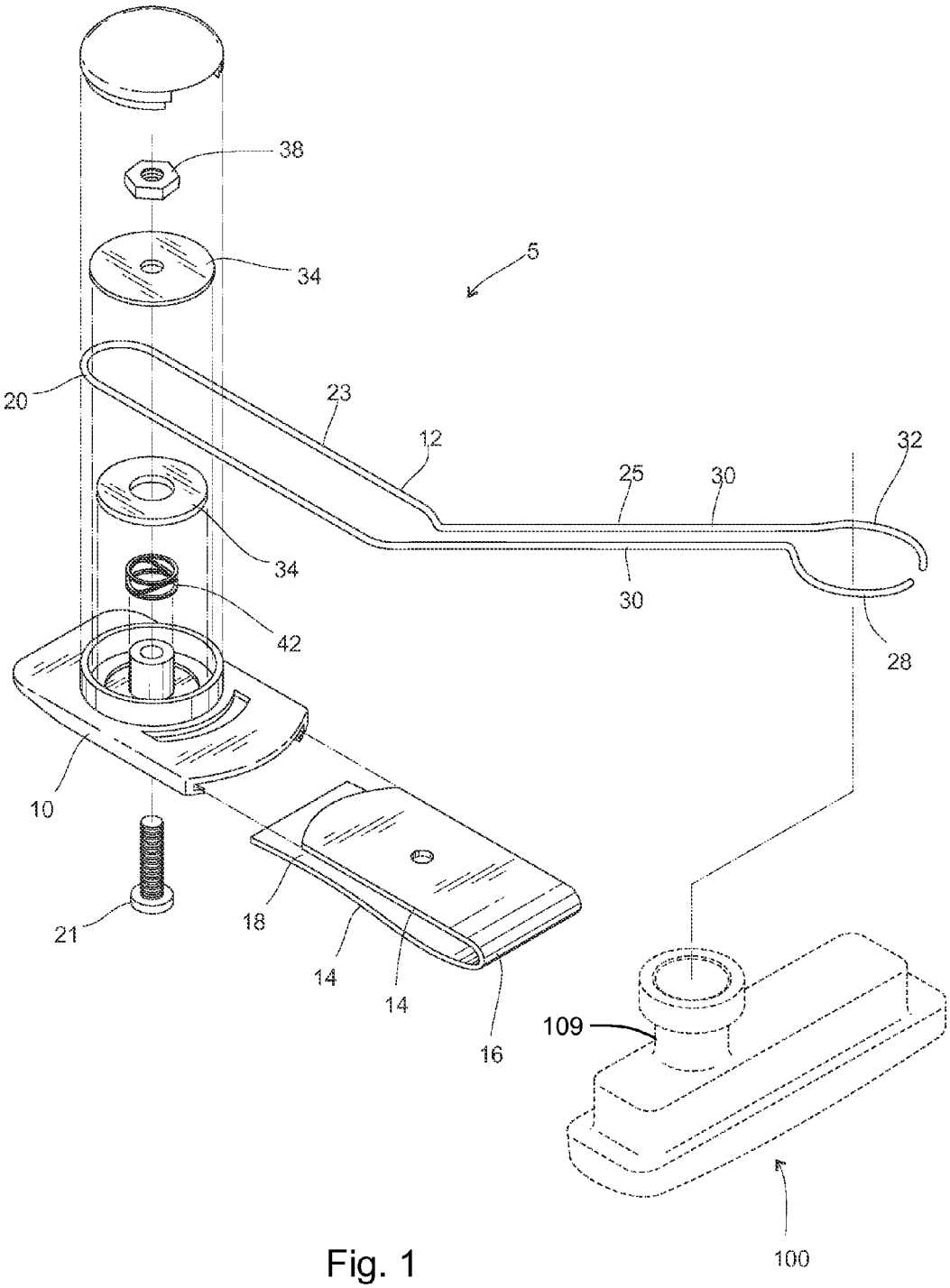
FIG. 1 is an exploded perspective view of the bracket of the present invention.
Figure 2:
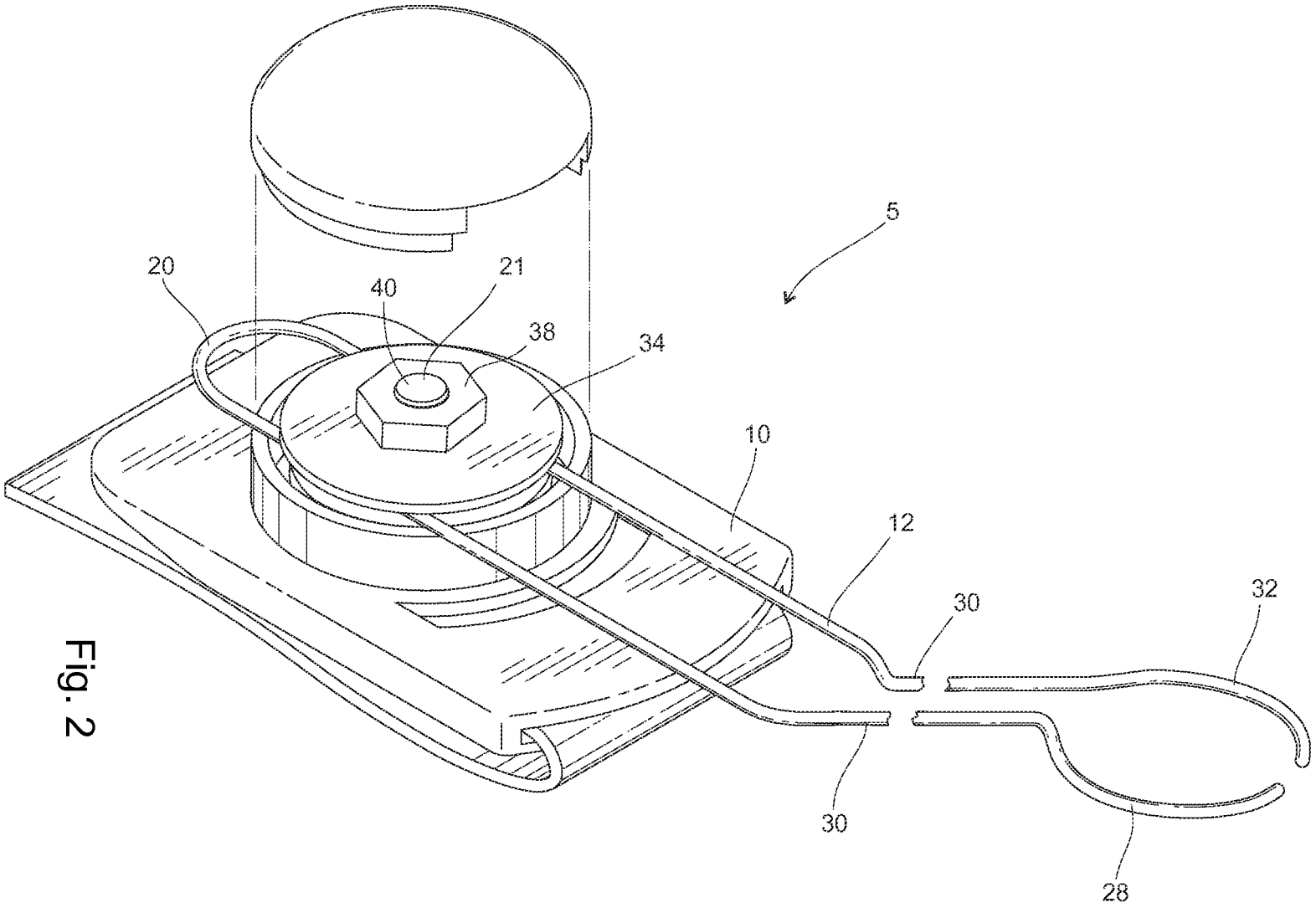
FIG. 2 is a perspective view of the assembled bracket of FIG. 1 with a cap aligned to cover a portion of the assembly.
Figure 3:
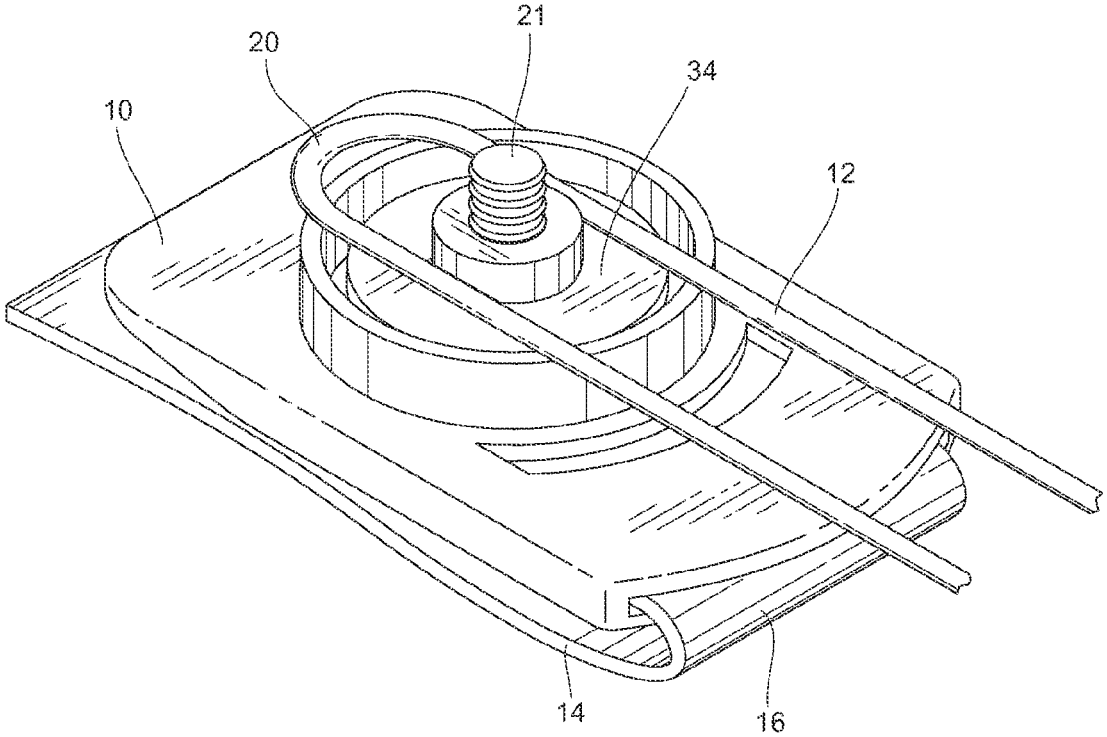
FIG. 3 is perspective view of the bracket of FIG. 1 partially assembled showing a clip, a friction member on the clip, an elongate member with a slot over the friction member with a spacer within the slot, and a shaft of a bolt extending upward through the clip and continuing through a hole in the friction member and a hole in the spacer.
Figure 4:
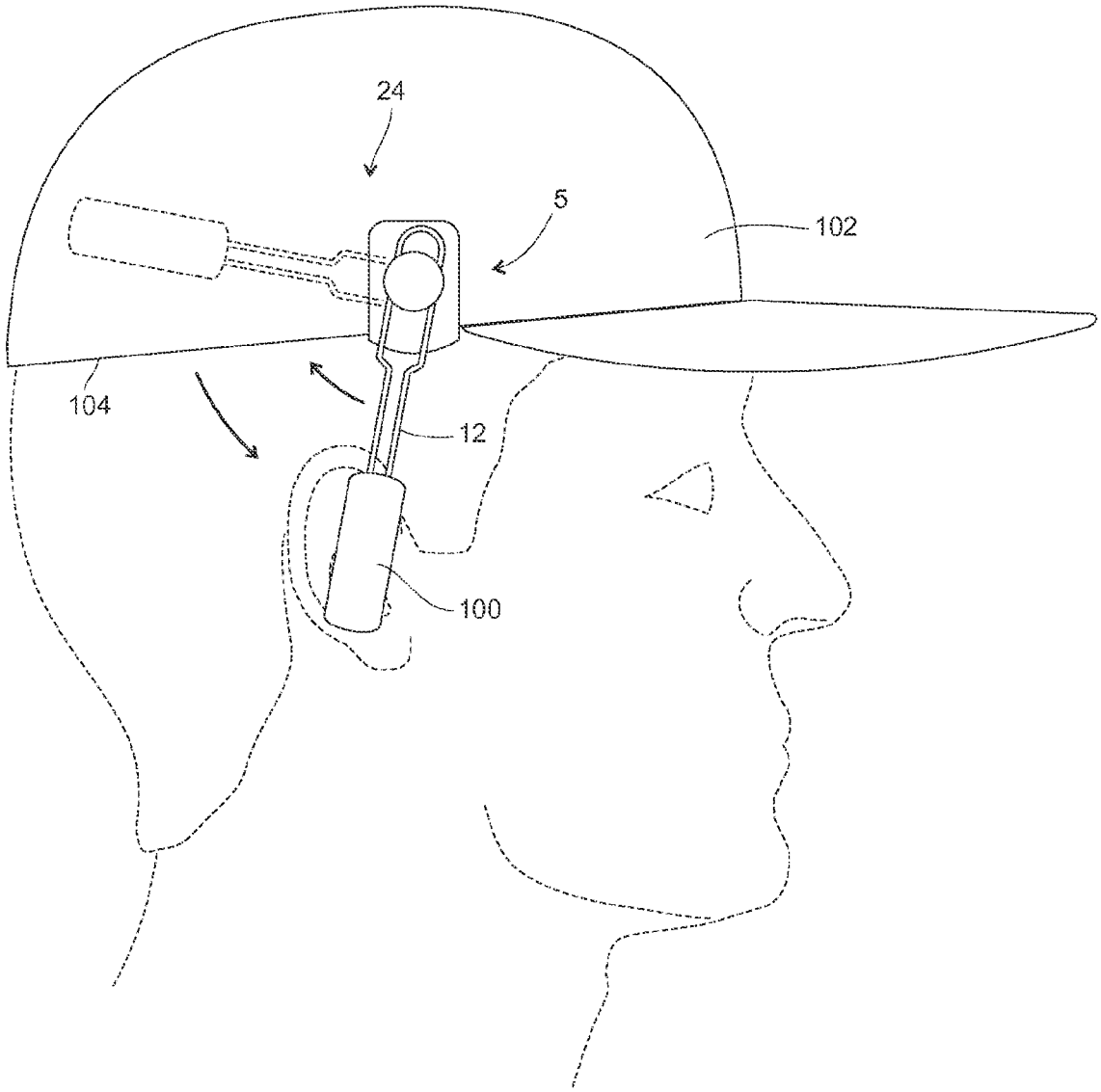
FIG. 4 is an artistic view of the bracket of FIG. 1 attached to a cap in its operational first position.
Figure 5:
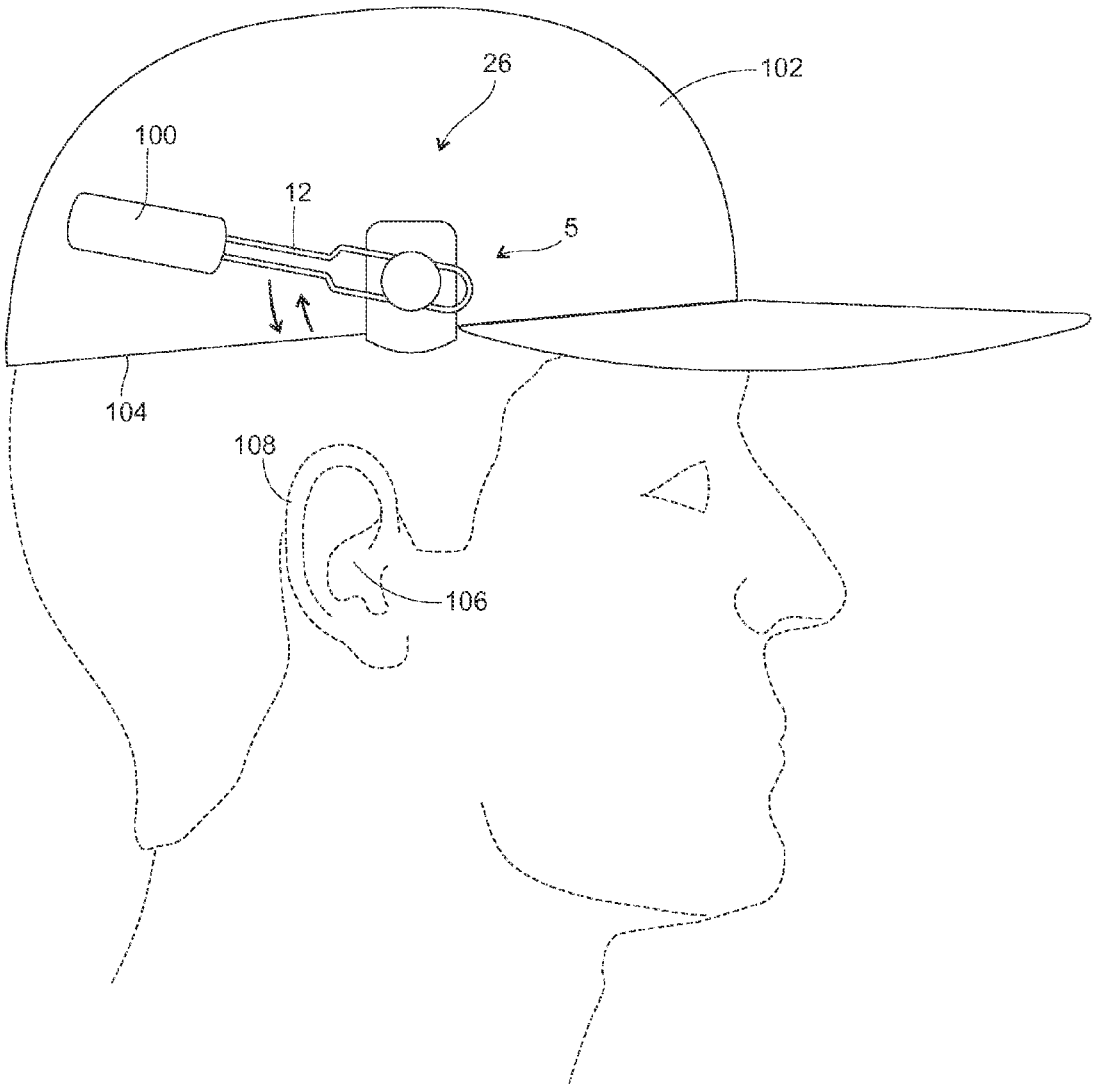
FIG. 5 is an artistic view of the bracket of FIG. 1 attached to the cap of FIG. 4, rotated to a non-operational second position alongside the cap.
Figure 6:
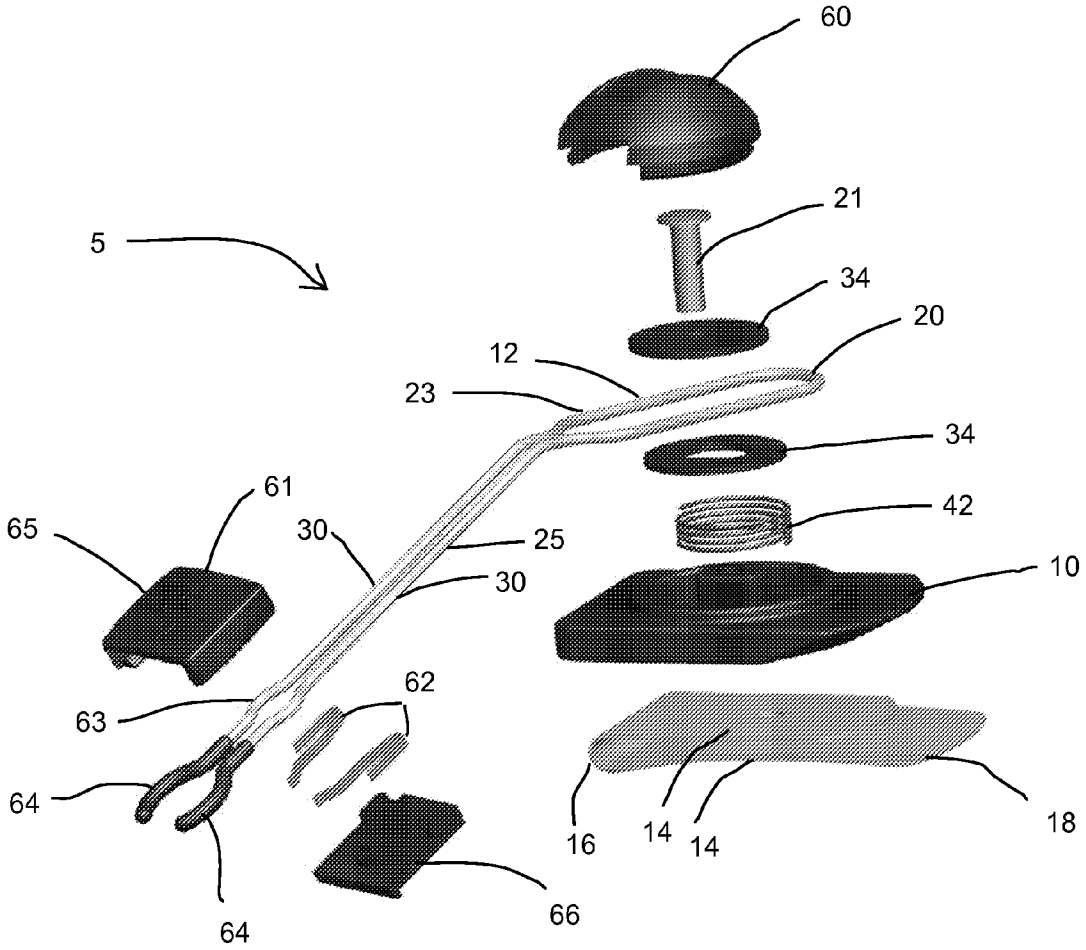
FIG. 6 is an exploded perspective view of the bracket of the present invention.

The bracket 5 of the present invention for suspending a cell phone earpiece 100 from a user's headgear 102 primarily comprises a clip 10 temporarily attachable to the headgear 102 and an elongate member 12 to which an earpiece 100 may be secured. Typically the headgear 102 is a cap that has a rim 104 to which the clip 10 temporarily attaches. To attach to the headgear 102 the clip 10 comprises two opposing members 14 mutually bending from each other at a line of flexure 16 forming a channel 18 therebetween. The cap rim 104 is then receivable temporarily into the channel 18 under spring bias from the line of flexure 16 that binds the cap rim 104 between the opposing members 14.

The elongate member 12 is mounted pivotably to the clip 10 near an elongate member first end 20 on a bolt 21 extending from the clip 10. The elongate member 12 may thus rotate on the clip 10 thereby moving the earpiece 100 secured in an earpiece position 22 on the elongate member 12 between first and second positions 24, 26. In the first position 24, the earpiece when mounted in the earpiece position 22 is over the external auditor meatus 106 of the user. The elongate member 12 comprises first and second sections 23, 25 curved inward at least a portion of which is resiliently flexible such that the earpiece 100 in the earpiece position 22 is urged under spring bias against the user's ear 108 in use. Clearly, the elongate member 12 may instead comprise an actual curve. In the second position 26, the earpiece 100 is swiveled away from the user's ear 108, which may be conveniently alongside the headgear 102 so as not to interfere with or distract the user.

The earpiece 100 is secured to the earpiece position 22 at an elongate member second end 28. The elongate member second end 28 may comprise a resilient wire form with a pair of legs 30, in which case the earpiece position 22 may be along the legs 30 but is preferably at the gripping portion 32 with the legs 30 grasping the earpiece 100 between them.

The elongate member 12 is also slidably mounted to the clip 10. The bolt 21 passes through a slot 23 longitudinal in the elongate member 12 therein providing adjustment of distance between the clip 10 and the earpiece position 22 in the elongate member 12 to facilitate positioning of the earpiece 100 over the external auditory meatus 106 of the user.

At least one friction member 34 is installed over the bolt 21 on a side 36 of the elongate member 12, and typically over and under the elongate member 12, providing a friction interface between the elongate member 12 and the clip 10.

A nut 38 on the bolt end 40 binds the friction member or members 34 against the elongate member 12 at a preferred pressure as the nut 38 is tightened on the bolt 21. Under the friction provided by the friction members, which may be fiber washers, the elongate member 12 moves relative to the clip 10 under positive action by the user and otherwise maintains a fixed position during use.

A coil spring 42 may be provided through which the bolt 21 passes and which the nut 38 compresses as the nut 38 is tightened to maintain a preferred pressure against the friction member or members 34. For ease of description the shaft that extends from the clip 10 through the spring 42 and the friction member or members 34 is represented by a bolt 21 with the assembly held in place by a nut 38 in cooperation with the bolt 21. The bolt and nut are common and well known parts used for this purpose. However, there are also other parts, such as rivots and pins, etc. that are suitable to perform the same function. A locking nut or a second nut also can be used along with the first nut to prevent the nut from unthreading on a bolt. There are similar other parts that can be used to prevent the nut from unthreading. All of these parts are represented by the use of the term 'nut' and for all purposes herein should be deemed included in the use of the term 'nut.' For all purposes herein, use of the terms 'bolt' and 'nut' are for ease of description only and should be deemed to represent all other common and well known parts that perform the same function. For generality, the bolt and similarly functioning parts may be described as a shaft herein and the nut and similarly function parts may be described as a securing member. A cap 60 covers the bolt 21 and frictional members 34 for aesthetic reasons and to prevent soil from interfering with the sliding function.

The elongate member 12 also has a pair of detents 63 near the elongate member second end 28 having one detent 63 on each of the pair of legs 30. The detents 63 provide a locking feature when combined with locking mechanism 61. The locking mechanism 61 has a locking mechanism channel 65 which fits over and slides along the elongate member second section 25. Within the locking mechanism channel 65 are two compliant springs 62 which bend when the locking mechanism 61 is slid over the detent 63. The compliant springs 62 relax after the detent 63 preventing the locking mechanism 61 from sliding back up the elongate member second section 25 toward the elongate member first end 20. A channel closeout 66 attaches to the locking mechanism channel 65 to keep the locking mechanism 61 slideably attached to the elongate member second section 25.

Gripping portions 32 are coated with a frictional coating 64 to enhance gripping of the cell phone earpiece 100. The frictional coating 64 is preferably soft vinyl but maybe any rubber, plastic, silicon or adhesive or means for increasing friction. The frictional coating 64 is coated to a thickness of between 0.005 to 0.08 inches.

The friction member 34 is preferably made from a fiber washer which provides the optimum friction on the elongate member 12. This washer can also be metal, plastic, neoprene, or mica. The bolt 21 is tightened to apply between one to eight pounds of force on the fiber washer 34. This results in a friction force between the fiber washer 34 and the elongate member 12 which is low enough to allow adjustment without pulling the bracket 5 from the users headgear 102 and high enough that the weight of the cellphone earpiece 100 does not cause unwanted adjustment or dangling.

Gripping portions 32 are shaped in a ellipse which allows the bracket 5 to grip a cell phone earpiece 100 with a neck 109 between 0.18 and 0.50 inches. This wide range of operation is made possible by the detents 63 working in concert with the locking mechanism 61 to react lateral or out of plane loads which would cause the cellphone earpiece 100 to twist out of the grip of the gripping portion 32. The locking mechanism 61 keeps the detents 63 planar during use.

The bracket 5 is made preferably for Bluetooth™ SIG protocol featured earpiece devices.

The channel 18 is flexible steel or other such material and is designed preferably to have clamping force necessary to attach to a cloth hat between 0.01 and 0.25 inches thick and not slide off under the weight of the bracket 5 and wireless earpiece 100. The bracket 5 does not require a rigid surface for mounting and is suited for flexible cloth hats 102.

The elongate member 12 is preferably made from stainless steel piano wire in a range between 0.02 and 0.08 inches in diameter. It is suitable to make the elongate member 12 from other metals and coated if not stainless.

The elongate member 12 moves relative to the clip 10 by sliding between friction members 34. This sliding adjustment is between 0.9 and 2.0 inches which allows for most users headgear 102 positions and head sizes.

To prevent interference with the tragus of the user; the clip 10 must be placed on a user headgear 102 at a position in front of the users ear and the elongate member 12 reaches back to the users ear above the tragus and over the inner ear. The optimal angle is between 5 and 31 degrees forward of vertical from the inner ear.

The compliant springs 62 preferably exert a force of between 0.2 and 7 pounds on the elongate member 12. This force holds the gripping portion 32 together to steady the cellphone earpiece 100 and not allow sloppy movement. The force is not so high that the user would have trouble moving the locking mechanism 61 over the detents 63.

The elongate member 12 comprises first and second sections 23, 25 curved inward at least a portion of which is resiliently flexible such that the earpiece 100 in the second position 26 is swiveled away from the user's ear 108, which may be conveniently held alongside the headgear 102 so as not to interfere with or distract the user. The earpiece 100 is held against the headgear 102 (and out of the way) by spring force induced in the flexure of the elongate member which causes friction between the soft earpiece 100 and the cloth headgear 102. The purpose of the flexure of the elongate member 12 is primarily to keep the earpiece 100 away from the ear rather than to push the earpiece 100 into the ear.

The invention claimed is:

1. A bracket attached to head gear comprising, a wireless cell phone ear piece, a clip adapted to attach to the headgear;

an elongate member mounted to the clip near an elongate member first end and adapted to secure an earpiece within a gripping portion at an elongate member second end;

wherein the elongate member is adjustable such that with the clip attached to the headgear, the earpiece when secured to the elongate member, earpiece position may move between a first position over the user's external auditory meatus and a second position spaced apart from the first position away from the user's ear wherein the elongate member is mounted pivotably to the clip such that the elongate member may rotate on the clip thereby moving the earpiece in the earpiece position between first and second positions, wherein the elongate member is adjustable in length such that the position of the earpiece position relative to the clip is adjustable to facilitate positioning of the earpiece over the external auditory meatus of the user, wherein the elongate member has at least one detent near the elongate member second end, a locking mechanism configured to provide a locking feature when combined with the detents, the locking mechanism having a locking mechanism channel which fits over and slides along an elongate member second section, the locking mechanism channel containing two compliant springs which lock over the detent preventing the locking mechanism from sliding back up the elongate member second section toward the elongate member first end, a channel closeout attached to the locking mechanism channel is configured to keep the locking mechanism slideably attached to the elongate member second section.

2. The bracket of claim 1 wherein the elongate member is slidably mounted to the clip therein providing adjustment of distance between the earpiece and the clip, wherein the elongate member is mounted to the clip with a friction interface such that the elongate member moves relative to the clip and otherwise maintains a fixed position during use.

3. The bracket of claim 2 further comprising at least one friction member on a side of the elongate member, a shaft extending from the clip and passing through a slot longitudinal in the elongate member, the shaft being disposed to bind the at least one friction member against the elongate member at a preferred pressure by a securing member on the shaft, wherein the shaft passes through the at least one friction member and the slot of the elongate member.

4. The bracket of claim 3 wherein the friction member is a fiber washer.

5. The bracket of claim 4 wherein a bolt is tightened to apply between one to eight pounds of force on the fiber washer resulting in an optimum friction force between the fiber washer and the elongate member.

6. The bracket of claim 3 where the sliding adjustment between the elongate member and the clip is between 0.9 and 2.0 inches allowing for most headgear positions and head sizes.

7. The bracket of claim 3 further comprising a coil spring through which the shaft passes, the securing member compressing the spring in cooperation with the shaft, the spring maintaining a preferred pressure against the friction member or members.

8. The bracket of claim 1 wherein the clip comprises two opposing members mutually bending from each other at a line of flexure forming a channel, configured to receive a cap rim into the channel under spring bias from the line of flexure between the opposing members.

9. The bracket of claim 1 wherein the gripping portion is coated with a frictional coating to enhance gripping of the cell phone earpiece, the frictional coating being means for increasing friction coated to a thickness of between 0.005 to 0.08 inches.

10. The bracket of claim 1 wherein the gripping portion is shaped in an ellipse which allows gripping of a neck between 0.18 and 0.50 inches, thus making it possible to grip a wide range of cell phone earpieces.

11. The bracket of claim 1 wherein the cell phone earpiece is a SIG protocol earpiece.

12. The bracket of claim 1 wherein the clip is flexible steel configured to attach to a cloth hat between 0.01 and 0.25 inches thick and not slide off under the weight of the bracket and the wireless earpiece.

13. The bracket of claim 1 wherein the elongate member is made from stainless steel piano wire in a range between 0.02 and 0.08 inches in diameter.

14. The bracket of claim 13 wherein the elongate member is made from a non-stainless material and has a coating applied.

15. The bracket of claim 1 wherein the enlongate member is configured to reach from an angle of between 5 and 31 degrees from vertical.

16. The bracket of claim 1 wherein the compliant springs exert a force of between 0.2 and 7 pounds on the elongate member which holds the end of legs together to steady the cell phone earpiece and allow movement of the locking mechanism over the detents.

17. The bracket of claim 1 wherein the elongate member comprises a first and second sections curved inward and at least a portion of which is resiliently flexible such that the earpiece in a second position, swiveled away from the user's ear, is configured to be held against the headgear by spring force induced in the flexure of the elongate member which causes friction between the earpiece and said headgear.

18. A bracket attached to head gear comprising, a clip comprising two opposing members mutually bending from each other at a line of flexure forming a channel, the cap rim being temporarily receivable into the channel under spring bias from the line of flexure binding the cap rim between the opposing members, an elongate member mounted to the clip near an elongate member first end and adapted to secure any make or model of a wireless cellular earpiece in a gripping portion in the elongate member at an elongate member second end, wherein the elongate member is curved inward at least a portion of which is resiliently flexible such that in use the earpiece when secured in the elongate member earpiece position is urged under spring bias against the user's ear;

wherein the elongate member is adjustable such that with the clip attached to the rim of the cap the earpiece when secured to the elongate member earpiece position may move between a first position over the user's external auditory meatus and a second position spaced apart from the first position away from the user's ear;

wherein, the elongate member is mounted pivotably to the clip on a shaft extending from the clip, such that the elongate member may rotate on the clip thereby moving the earpiece in the earpiece position between first and second positions, wherein the elongate member has at least one detent near the elongate member second end, a locking mechanism configured to provide a locking feature when combined with the detents, the locking mechanism having a locking mechanism channel which fits over and slides along an elongate member second section, the locking mechanism channel containing two compliant springs which lock over the detent preventing the locking mechanism from sliding back up the elongate member second section toward the elongate member first end, a channel closeout attached to the locking mechanism channel is configured to keep the locking mechanism slideably attached to the elongate member second section, wherein, the gripping portion is coated with a frictional coating to enhance gripping of the cell phone earpiece, the frictional coating being means for increasing friction coated to a thickness of between 0.005 to 0.08 inches.

* * * * *